United States Patent [19]

Palau et al.

[11] Patent Number: 4,832,087

[45] Date of Patent: May 23, 1989

[54] NEGATIVE DOBBIES OF THE TYPE INCORPORATING SWINGING LEVERS

[75] Inventors: Joseph Palau, Duingt; Jean-Pierre Pages, Faverges; Jean-Paul Froment, Doussard, all of France

[73] Assignee: S.A. Des Etablissements Staubli, Faverges, France

[21] Appl. No.: 133,916

[22] Filed: Dec. 16, 1987

[30] Foreign Application Priority Data

Jan. 9, 1987 [FR] France ..... 87 00297

[51] Int. Cl.[4] ..... D03C 1/08

[52] U.S. Cl. ..... 139/71

[58] Field of Search ..... 139/68, 71, 72, 74

[56] References Cited

U.S. PATENT DOCUMENTS 4,182,380 1/1980 Palau ..... 139/71

FOREIGN PATENT DOCUMENTS 2638524 10/1977 Fed. Rep. of Germany ..... 139/71

2543172 9/1984 France ..... 139/71

*Primary Examiner*—Henry S. Jaudon

*Attorney, Agent, or Firm*—Dowell & Dowell

[57] ABSTRACT

In negative dobbies of the type incorporating swinging lever assemblies to which lever elements are connected and which lever elements support two articulated hooks, retaining members are provided in the form of pivotable locks placed between the bearing face of each hook and the pivot pins by way of which the hooks are mounted to the lever elements.

5 Claims, 4 Drawing Sheets

NEGATIVE DOBBIES OF THE TYPE INCORPORATING SWINGING LEVERS

BACKGROUND OF THE INVENTION

1. Field of the Invention

The present invention relates to negative dobbies of the type incorporating swinging levers, intended for controlling the heddle frames on weaving machines.

2. Description of the Related Art

It is known that, in dobbies of the type referred to above each heddle frame is actuated against the action of springs or other elastic means which tend to return the frame to one of the two ends of its reciprocating vertical stroke. As illustrated schematically in FIG. 1 of the accompanying drawings, which figure is a schematic transverse section of a conventional dobby, each heddle frame C is coupled to a cable and/or a drawing arm 1 to a suspension lever 2 articulated at 3 on the frame 4 of the dobby. A connecting rod 5 joins each lever 2 to a lever assembly 6 supporting a lever element, the lever assembly 6 being pivotally supported on a common pivot pin 7; each lever assembly lever 6 is equipped at its free end with a lever element 8 provided at its ends with articulated hooks 9.

In order to swing each lever element 8 about its pivot pin 10 carried by the corresponding lever 6, there is provided an actuating mechanism comprising two crosspieces 11 which are carried by two lateral rocking elements 12 so as to bear against the bead of the hooks 9. Any actuating mechanism, formed for example by arms 13 coupled to the rocking elements 12 and fitted in eccentric manner on a transverse shaft 14, imparts to the rocking elements a continuous rocking movement about their fixed pivot 15.

In conventional constructions, each of the two articulated hooks 9 carried by each level element 8 is sectioned so as to cooperate with a corresponding retaining member 16 in the form of a hook, which pivots about a common pivot pin 17 under the effect of a reading device 18 of the type incorporating pegs or punched paper, which device contains the weaving program for making the fabric desired.

From the practical standpoint, this embodiment presents appreciable drawbacks.

It will firstly be observed that, due to the respective positioning of pieces 9 and 16 of each pair, combined with the orientation of the fastening faces of such pieces, these latter work in bending, with the result that, in order to avoid any bending having regard to the considerable efforts to which said pieces are subjected in operation, large sections must be provided which obviously increase the masses that the reading device 18 must maneuver. Consequently, the springs associated with the hooks 16 (referenced 16a in FIG. 1), or incorporated in the device 18 must be more powerful; at the same time, the selection time (i.e. the operational rhythm of the reading device) must be extended, which reduces the speed of the dobby.

Moreover, and as illustrated more precisely in FIG. 2 of the accompanying drawings, which figure shows on a large scale the the lower hook of one of the lever elements 8 of a conventional dobby, the unfavourable path of the pieces 9 and 16 makes it necessary to provide greater strokes for ungripping or disengaging the members which slow down the operational speed of the dobby. Effectively, concerning the horizontal displacement of each hook 9, ungripping, i.e. the distance that said hook must cover beyond the hooked position in order to allow its disengagement from the corresponding hook 16, is equal, not to the value d1 corresponding solely to the operational clearance, but to value d2 due to the obliqueness necessarily given to the bearing faces of the hooks.

Such increase in the ungripping or disengages stroke must be taken into account both at the level of the actuating mechanism 13-14 associated with the crosspiece-supporting rocking elements 12 and at the level of the reading device 18, with the result that it has a detrimental influence on the operational speed of the dobby.

SUMMARY OF THE INVENTION

It is an object of the present invention to overcome these drawbacks essentially by forming the pivoting retaining member associated with each of the two hooks carried by each lever element, in the form of a lock disposed between the bearing face of one hook and the pivot pin of the hook on the corresponding lever element.

BRIEF DESCRIPTION OF THE DRAWINGS

As illustrated in FIG. 3 of the accompanying drawings, each retaining lock is advantageously formed by a lever referenced 19, pivotally carried on one or the other of two common transverse pins 20, similar to pins 17 of the conventional construction according to FIG. 1. This lever 19 includes two radial arms of which one is coupled by an independent pusher 21 to the reading device 22 of the dobby, while the other is sectioned at its free end to cooperate with the bearing face made in the corresponding hook, referenced 23, of the lever element 8 shown.

FIG. 4 shows on a still larger scale the lower hook 23 of one of the lever elements and the retaining lock 19 which is associated therewith. The pivot pin 20 which carries each lock 19 being disposed between the bearing face **23*a* of the hook 23 and the pivot pin 24 of the hook on the lever element 8. This lock words in compression, with the result that, in order to withstand the same efforts, or stresses it may have a much reduced mass as compared with respect to that of the conventional hooks 16** working in bending.

According to a particularly advantageous arrangement of the invention, each common pivot pin 20 is arranged to be located, not strictly on the straight line between the bearing face **23*a* to the pivot pin 24, but slightly offset outwardly with respect to such straight line. Such offset creates a torque which tends to rotate the lock in the direction indicated by arrow F, which has for its effect to apply the inner face of the hook Preferably, the hook 23 is provided with a boss 23***b* against the common pivot pin 20. It will be noted that, to ensure a better bearing of the hook 23, the lock 19 is partially notched around pin 20 adjacent the boss 23*b*.

This bearing position is balanced, with the result that a position of stable equilibrium is thus permanently conserved.

Figure 2:
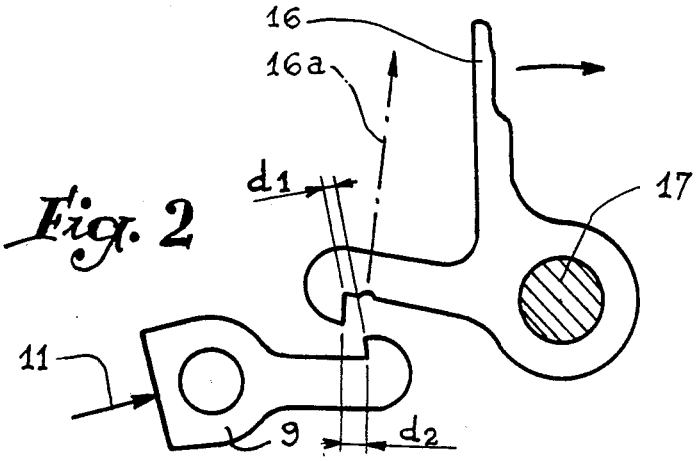
Fig. 2 PRIOR ART
FIG. 2 is an enlarged illustrational view of one of the articulated hooks and an associated retaining member shown in FIG. 1.
Figure 5:
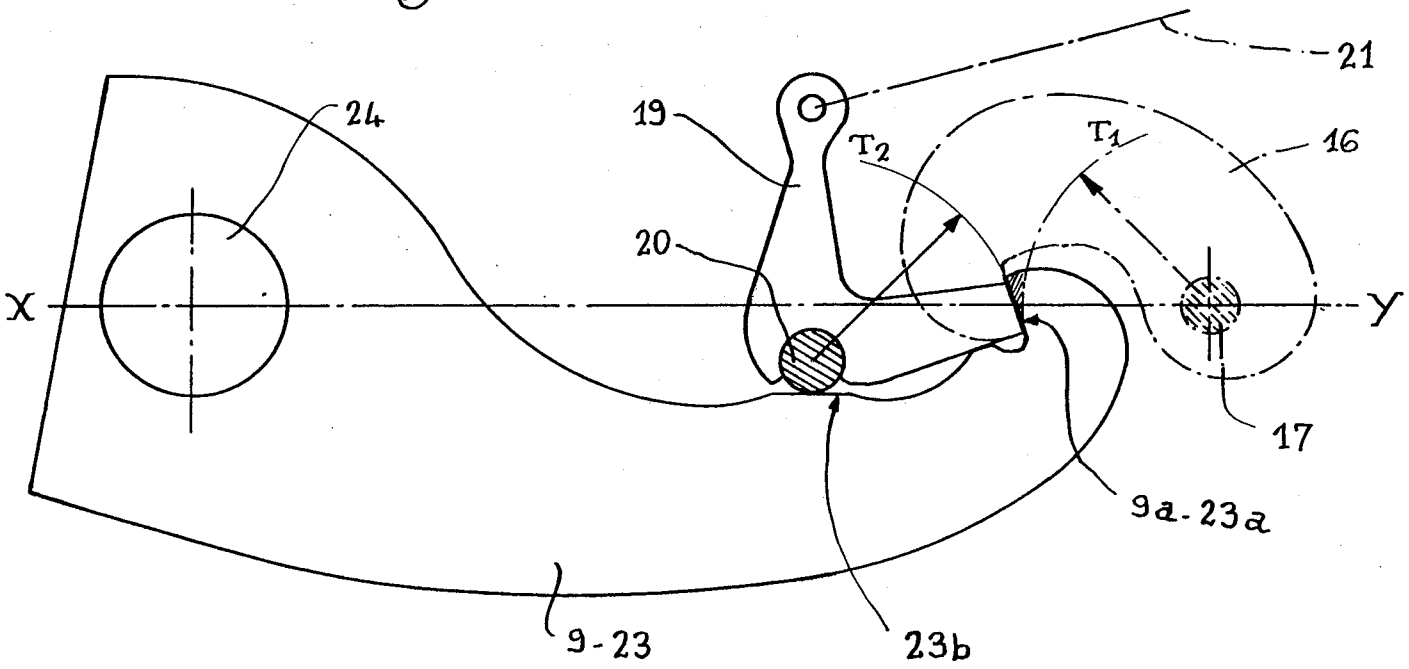
FIG. 5 is an enlarged schematic illustrational view of the retaining lock of the present invention in full line and the retaining member of the prior art in dotted line.

Whatever the solution adopted, it should be observed that, as illustrated in FIG. 5, which simultaneously shows the conventional construction (in broken lines) and the construction according to the invention, the path of the locks 19 during their rotation is much more favourable than in the case of the prior art construction and consequently allows reduction of the ungripping clearance, allowing an increase in the operational speed of the dobby without increasing the risks of defects of ungripping. In fact, the following is observed:

while, in the conventional construction, taking into account the inclination of the bearing face 9*a* with respect to the line of force X-Y passing necessarily through axes 24 and 17, the path T1 of the nose of the hook 16 moves towards the the bearing face, therefore making it necessary to increase the ungripping clearance illustrated at d2 in FIG. 2, in the case of lock 19 of which the pivot pin 20 is located between the bearing face 23*a* and the pin 24, the path T2 is substantially tangential to said face 23*a*, consequently allowing a minimum ungripping clearance.

Figure 1:
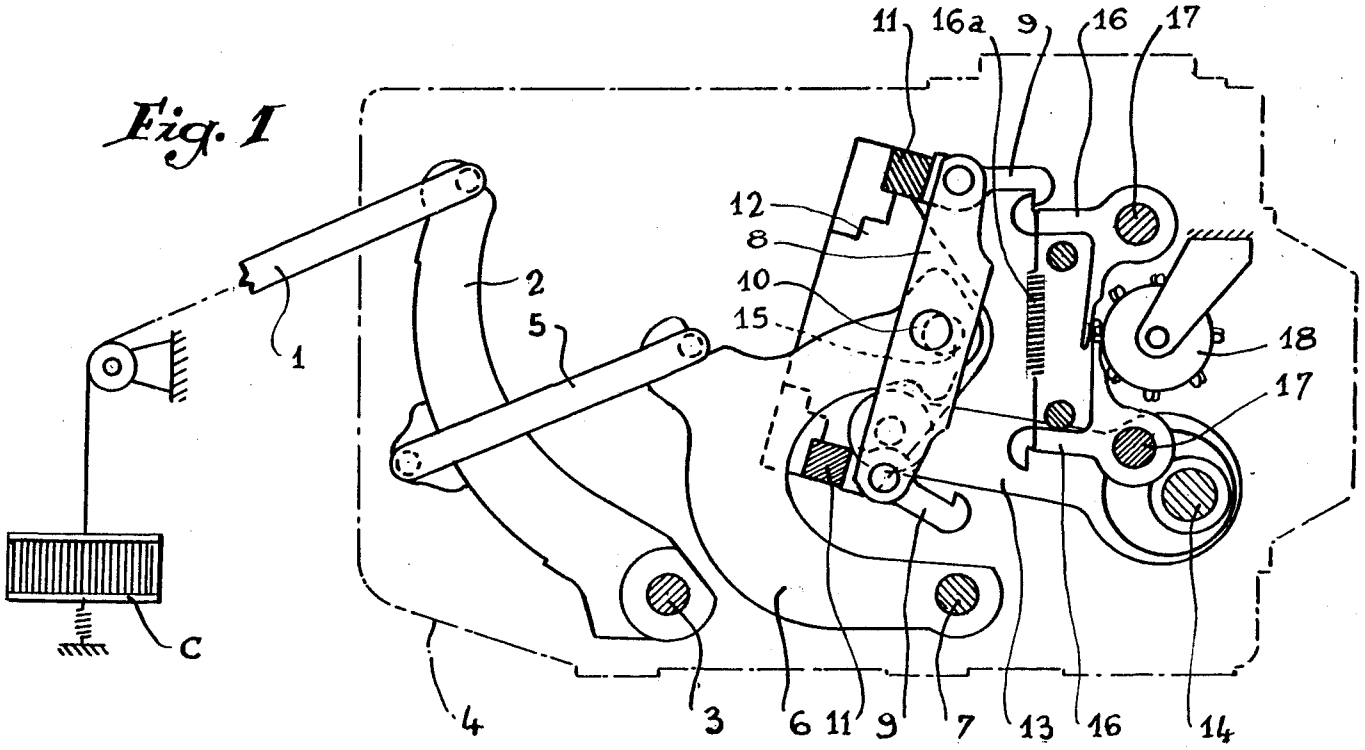
Fig. 1 PRIOR ART
FIG. 1 is a schematic transverse section fo a conventional dobby.
Figure 6:
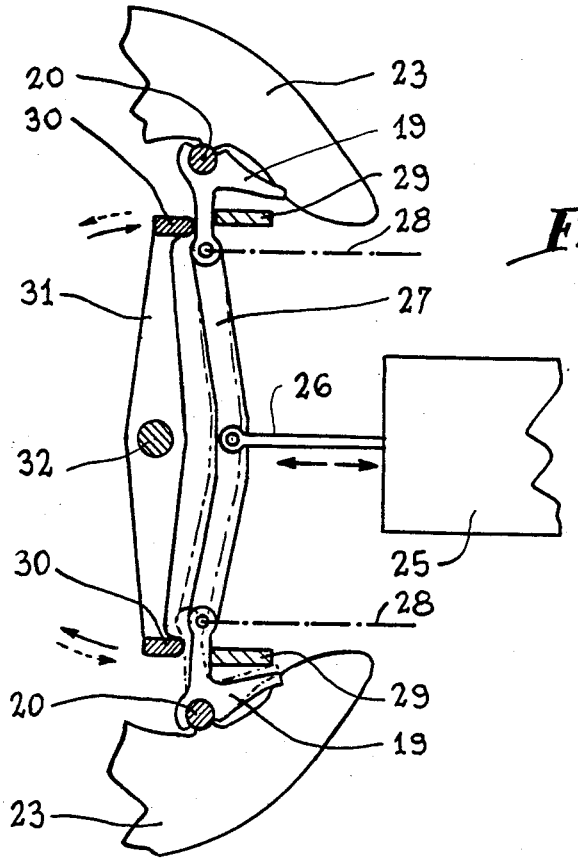
FIG. 6 is a partial schematic illustrational view of an alternate embodiment of control device for the retaining locks of the present invention.
Figure 3:
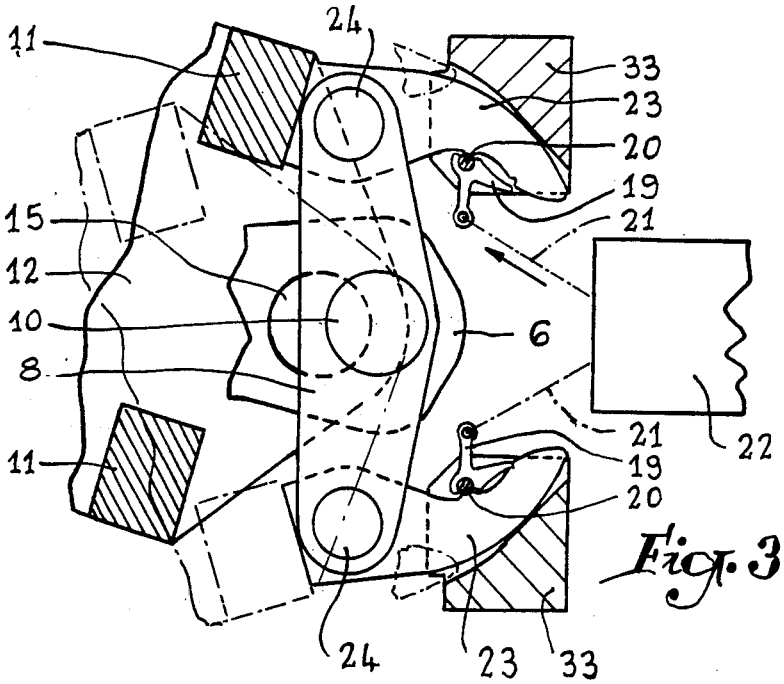
FIG. 3 is a transverse section of the dobby of the present invention.
Figure 4:
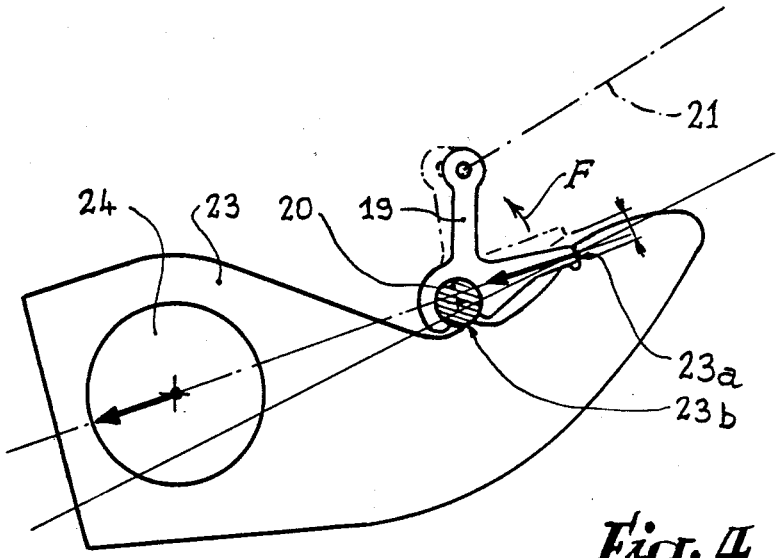
FIG. 4 is an enlarged illustrational view of one of the articulated hooks and an associated retaining lock of the present invention.

Returning to the structural standpoint, it will be observed that, in the embodiment shown in FIG. 3, the control of each lock 19 is obtained with the aid of an independent pusher 21 actuated by the reading device 22. However, the mode of actuation illustrated schematically in FIG. 6 may be adopted, employing a reading device 25 which comprises for each lever element 8 a single pusher 26, possibly doubled by an identical pusher intended for reverse operation. The free end of each pusher 26 is coupled to the centre point of a balance beam 27 which is pivoted on the two retaining locks 19 associated with the lever element embodiment shown. Springs or other elastic means 28 tend to maintain each lock 19 applied against a fixed stop 29, while two mobile stops 30 are provided, carried by a rocker 31 which a central shaft 32 which moves in a continuous rocking movement, in synchronism with the rocking movement of the rocking elements 12 mentioned above. It will be noted that the stops 29 and 30 are common to all the locks 19 of the dobby.

It will be understood that, when one of the stops 30 engages the actuating arm or shank of one of the locks 19 against the corresponding fixed stop 29, the pusher 26 may, if the program of device 25 provides this, push the balance beam 27 which rocks and controls pivoting of the opposite lock, which is at that moment free to move angularly due to the spaced relationship of the stop 30 which is associated therewith.

It should be observed that each of the two pins 20 on which the locks 19 of each row are articulated, is preferably mounted in the teeth of a comb-shaped support 33 as shown in FIG. 3. Each pin 20 is thus perfectly supported and may present a reduced diameter despite the considerable efforts exerted thereon. Furthermore, the bottom of the teeth of the supports or combs 33 is adapted to form a guide for the angular displacement of the hooks 23 in the event of the crosspiece 11 associated therewith is not bearing perfectly flat against the rear bead of the hook in question.

It must, moreover, be understood that the foregoing description has been given only by way of example and that it in no way limits the domain of the invention which would not be exceeded by replacing the details of execution described by any other equivalents.

What is claimed is:

1. A negative dobby for controlling the heddle frames on weaving looms wherein the dobby incorporates a swinging lever assembly which supports a lever element having articulated hooks carried on corresponding pivot pins adjacent the ends thereof which hooks are cooperatively engageable with pivotable retaining members controlled by a reading device, the improvement comprising each of said hooks having a bearing face which is in spaced relationship to and oriented generally toward a corresponding pivot pin, each of said retaining members including a locking lever means having a mounting portion and at least one outwardly extending free end portion, locking lever pivot pin means oriented generally parallel to said corresponding pivot pins and disposed generally between said bearing face of each of the hooks and their corresponding pivot pins, said mounting portion of each of said locking lever means being mounted to said locking lever pivot pins means so as to be pivotable with respect to said hooks, said free end portion of each of said locking lever means being selectively pivotable into engagement with said bearing face of said hooks.

2. The negative dobby of claim 1 in which each of said hooks includes an inner face which is spaced from said bearing face thereof and oriented generally toward said locking lever pivot pin means, said locking lever pivot pin means being offset laterally toward said inner faces of said hooks with respect to a line drawn between said bearing faces of said hooks and their corresponding pivot pins.

3. The negative dobby of claim 2 including an outwardly extending boss defined along said inner face of each of said hooks, said boss directly engaging said locking lever pivot pin means.

4. The negative dobby of claim 3 in which said mounting portion of each of said locking lever means includes a notch, said locking lever pivot pin means being receivable within said notches of said locking lever means.

5. The negative dobby of claim 1 in which said locking lever means includes first and second arms which extend radially outwardly with respect to said mounting portion thereof, said free end portion of said locking lever means being disposed along said first arm and means connecting said second arm to the reading device.

* * * * *